US005634556A

United States Patent [19]

Focke et al.

[11] Patent Number: 5,634,556

[45] Date of Patent: Jun. 3, 1997

[54] HINGE-LID BOX FOR CIGARETTES OR THE LIKE AND BLANK FOR PRODUCING THE SAME

[75] Inventors: Heinz Focke, Verden; Henry Buse, Visselhövede, both of Germany

[73] Assignee: Focke & Co. (GmbH & Co.), Verden, Germany

[21] Appl. No.: 433,729

[22] Filed: May 3, 1995

[30] Foreign Application Priority Data

May 3, 1994 [DE] Germany ..... 44 15 572.7

[51] Int. Cl.[6] ..... B65D 5/66

[52] U.S. Cl. ..... 206/268; 206/273; 229/160.1; 229/225

[58] Field of Search ..... 206/271, 273, 206/264, 265, 268, 274; 229/160.1, 87.13, 225

[56] References Cited

U.S. PATENT DOCUMENTS

| | | | |
|---|---|---|---|
| 2,881,970 | 4/1959 | Hovland . | |
| 2,963,214 | 12/1960 | Leone et al. . | |
| 4,942,961 | 7/1990 | Focke et al. | 229/100.1 X |
| 5,203,495 | 4/1993 | Jorgensen-Beck et al. | 206/273 X |
| 5,465,836 | 11/1995 | Focke | 206/273 X |

FOREIGN PATENT DOCUMENTS

| | | |
|---|---|---|
| 2677960 | 12/1992 | France . |
| 1105340 | 4/1961 | Germany . |
| 301802 | 5/1992 | Germany . |
| 2106869 | 4/1983 | United Kingdom . |

*Primary Examiner*—Jacob K. Ackun

*Attorney, Agent, or Firm*—Sughrue, Mion, Zinn, Macpeak & Seas

[57] ABSTRACT

In order to reduce the material and production costs, a hinge-lid box comprising a single all-in-one blank is desirable. In the case of a blank designed, in particular, in accordance with the transverse folding principle, the collar (12) is connected to a main blank (27) for the hinge-lid box, in the region of the folding tabs of the lid (11), via approximately triangular folding gussets (46, 47). The folding gussets (46, 47) are positioned such that, by folding the collar (46, 47) over against the inner side of the main blank, the collar automatically passes into the position which is appropriate for the pack. The folding gussets (46, 47) are connected to the collar (12) by material remnants (52, 53). When the lid (11) is opened for the first time, the material remnants (52, 53) are severed.

6 Claims, 6 Drawing Sheets

HINGE-LID BOX FOR CIGARETTES OR THE LIKE AND BLANK FOR PRODUCING THE SAME

BACKGROUND OF THE INVENTION

The invention relates to a hinge-lid box for cigarettes or the like, comprising a box part, a lid connected pivotably thereto, and a collar which is anchored in the box part and projects out of the same by means of a sub-region, the collar being connected to the lid by material webs and/or material remnants, which can be severed when the lid is opened for the first time.

Hinge-lid boxes for cigarettes or the like consist of a thin cardboard. The collar conventional for this type of pack is, in practice, a separate blank. This necessitates additional material and manufacturing outlay.

Proposals for a single-piece blank, in the case of which the collar is connected to a main blank for the hinge-lid box, have thus already become known.

In the case of a single-piece all-in-one blank, the collar has to be positioned such that, on the one hand, a material-saving is achieved and, on the other hand, the collar can be folded, by machine-specific folding steps, into the position which is appropriate for the pack.

SUMMARY OF THE INVENTION

Taking this requirement into account, the object of the invention is to configure a hinge-lid box with a collar or an all-in-one blank comprising a main blank and collar such that the collar is positioned in a material-saving manner within the all-in-one blank and, during production of the hinge-lid box, can be folded, by simple folding steps, into the position appropriate for the type of pack.

In order to achieve this object, the hinge-lid box according to the invention is characterized in that the collar is connected to the lid by intermediate pieces, in particular folding gussets, and in that the severable material remnants are formed between the collar, on the one hand, and the intermediate pieces or folding gussets, on the other hand.

The intermediate pieces, which are actually designed as essentially triangular folding gussets, ensure that the collar is positioned, by a first folding step, in a manner corresponding to the configuration of the hinge-lid box. By way of the intermediate pieces/folding gussets, a collar border which is at the top when the hinge-lid box is in a finished state is positioned at an appropriate distance from a top wall or end wall of the lid. The material remnants, which are severed when the lid is opened, are positioned such that the collar border progresses in a manner which is conventional in hinge-lid boxes and is of a conventional shape.

The (all-in-one) blank according to the invention is designed such that the collar is connected to the main blank, in the region of the lid, by the intermediate pieces or folding gussets. The folding gussets are formed in the region of folding edges of the collar, on the one hand, and of front-side longitudinal folding lines of the lids and/or of the main blank, on the other hand. The preferably triangular or trapezoidal folding gussets are connected to folding tabs of the collar via an articulation and to the collar via residual connections and/or material remnants.

Upon manufacture of the hinge-lid box, the collar, together with the folding gussets, is folded over against the inner side of the main blank such that the collar bears in a positionally correct manner against the inner side of front and side folding tabs of the lid and of the box part. In this arrangement, the collar is connected to the covered over regions of the box front part (box front wall and/or box side walls), in particular by adhesive bonding. The folding gussets further remain in connection both with the main blank and with the collar. When the hinge-lid box is in a finished state, material webs and/or residual connections between the folding gussets, on the one hand, and the collar, on the other hand, are severed.

Inner folding tabs of the lid top wall, namely corner tabs and an inner longitudinal tab, are supplemented in a positively fitting manner by the collar, namely by an upper border of the collar front wall and of the collar side tabs. The folding gussets are likewise delimited in a positively fitting member by the collar, on the one hand, and the inner folding tabs of the lid's top wall, on the other hand.

Further details of the invention relate to the design and arrangement of parts of the blank and to the folding operations as the hinge-lid box is formed.

An exemplary embodiment of a blank and of a hinge-lid box are described in more detail hereinbelow with reference to the drawings, in which:

DESCRIPTION OF PREFERRED EMBODIMENTS

Figure 1:
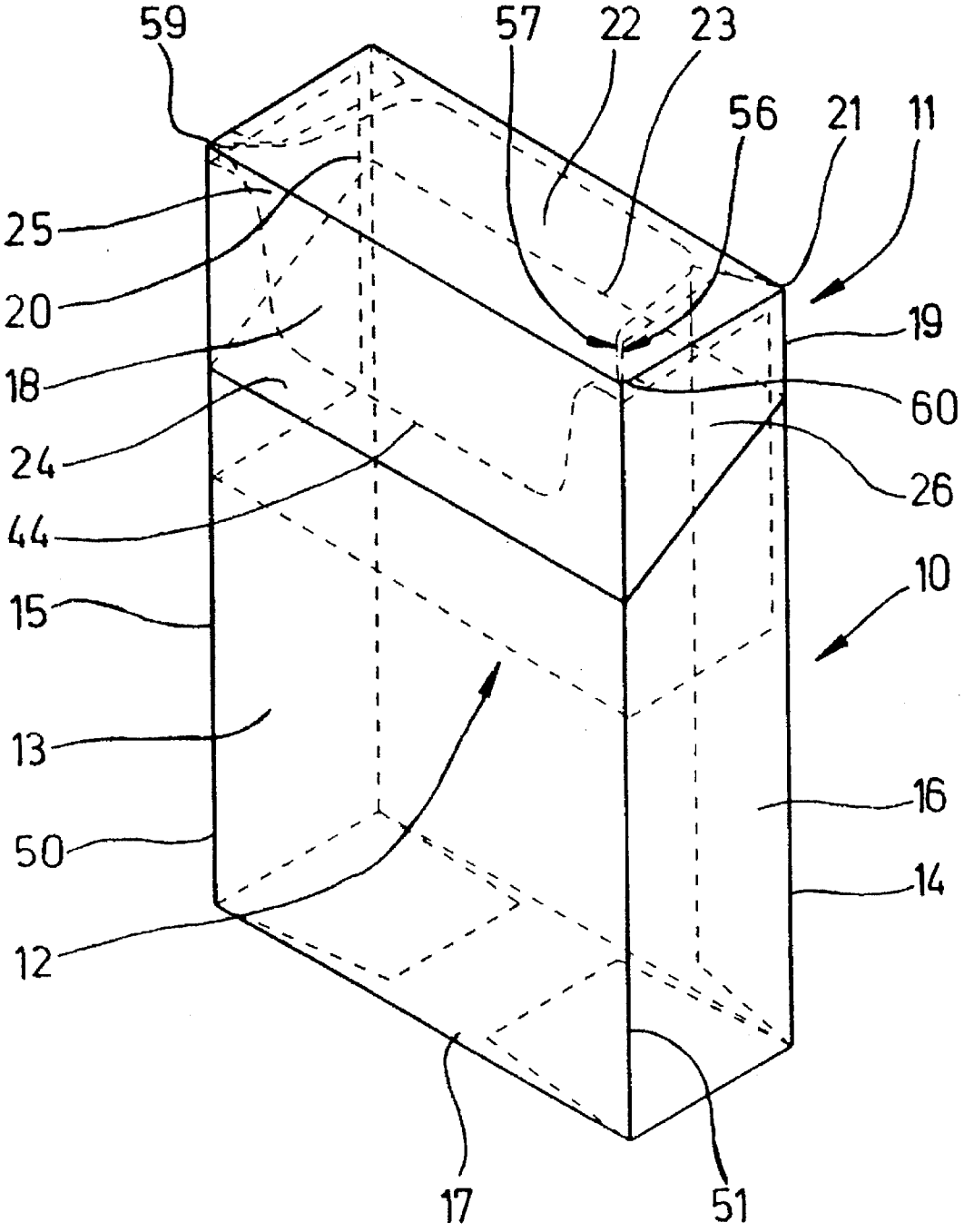
FIG. 1 shows a perspective representation of a closed hinge-lid box.

A hinge-lid box for receiving a cigarette group (not shown) enclosed by an inner wrapper comprises a (bottom) box part 10 and a lid 11. Fastened within the hinge-lid box is a collar 12, of which the lower region is seated in the box part and of which the region projecting out of said box part is enclosed by the lid 11 in the closed position.

The box part 10 forms a box front wall 13, a box rear wall 14, narrow, upright box side walls 15, 16 and a base wall 17. Accordingly, the lid 11 comprises a lid front wall 18, lid rear wall 19, narrow lid side walls 20, 21 and a top wall 22.

Box part 10 and lid 11 are connected to one another pivotably in the region of box rear wall 14 and lid rear wall 19, to be precise along an articulation line 23.

The collar 12 forms a collar front wall 24 and collar side tabs 25, 26. Said collar front wall bears, by means of the lower region, against the inside of the box front wall 13 and is connected thereto, for example by adhesive bonding. The collar side tabs 25, 26 are located on the inner side of the box side wall 15, 16.

As a whole, the hinge-lid box designed in this manner comprises an originally single-piece blank, preferably consisting of thin cardboard. The sub-region of the (all-in-one) blanks shown in FIG. 3, FIG. 4 and FIG. 5 comprises a main part, namely a main blank 27 for box part 10 and lid 11, and the collar 12 which is connected thereto.

Figure 3:
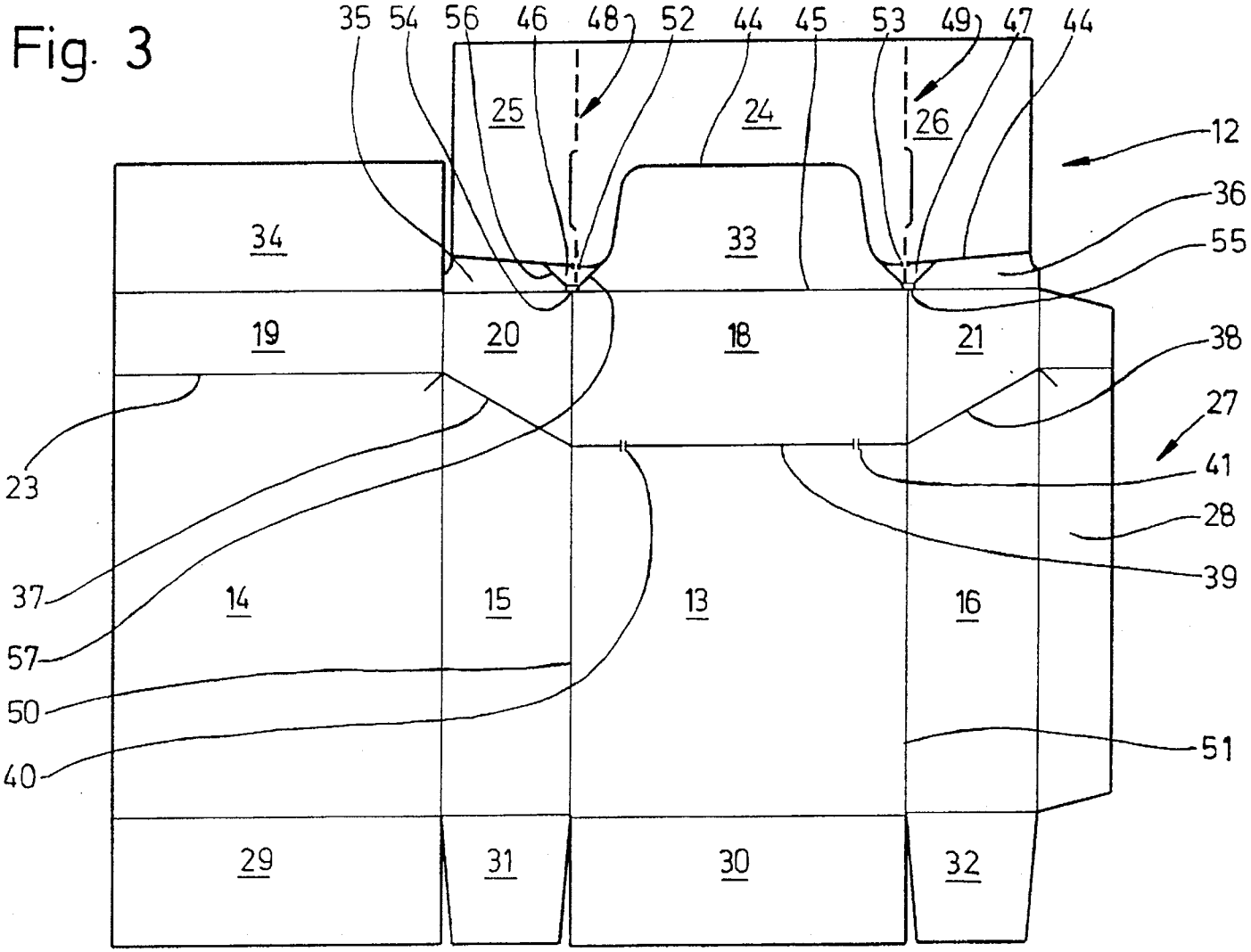
FIG. 3 shows a spread-out (all-in-one) blank for a hinge-lid box according to FIGS. 1 and 2.
Figure 4:
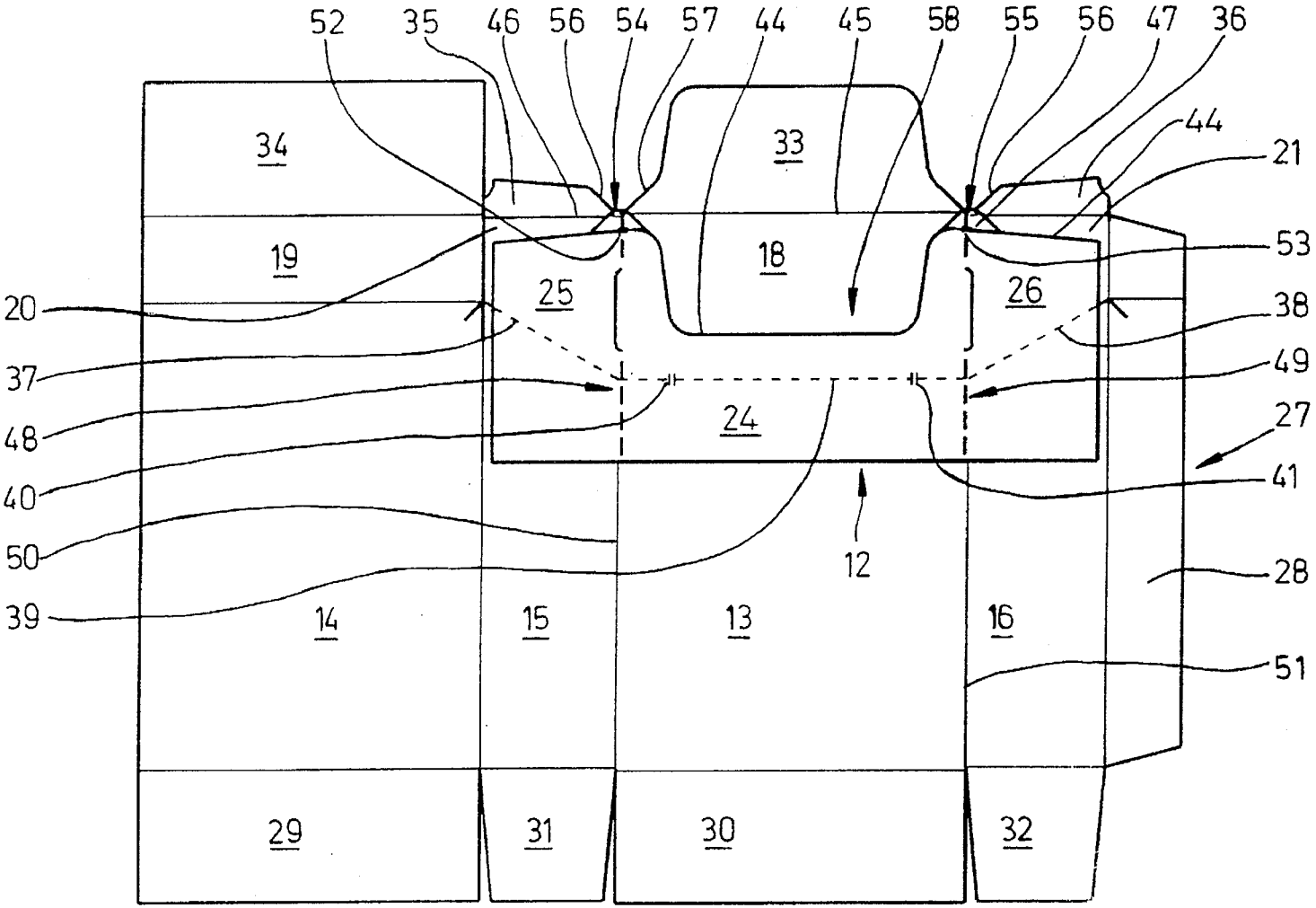
FIG. 4 shows a blank according to FIG. 3 in an intermediate folding position.

The main blank 27 and thus the hinge-lid box manufactured from it are, in the case of the exemplary embodiment of FIG. 3 and FIG. 4, constructed in accordance with the principle of "transverse folding". This means that, in the region of the main blank 27, the box rear wall 14, the box side wall 15, the box front wall 13 and the second box side wall 16 are positioned one after the other and one beside the other. Analogously, lid rear wall 19, lid side wall 20, lid front wall 18 and lid side wall 21 are arranged one beside the other in the transverse direction.

A connection strip 28 is provided in the region of three sides of the box side walls 16 and of the lid side wall 21. When the hinge-lid box is in the finished state, said connection strip is connected, in particular adhesively bonded, to the inner side of the box rear wall 14 and of the lid rear wall 19.

The base wall 17 is formed by a plurality of interconnected base tabs, namely by an inner longitudinal tab 29 in the region of the box rear wall 14, by an outer longitudinal tab 30 in the region of the box front wall 13, and by corner tabs 31 and 32 in the region of the side walls 15, 16 in each case.

Analogously, the top wall 22 of the lid comprises an inner tab 33, an outer cover tab 34 adjoining the lid rear wall 19, and side tabs 35, 36 adjoining lid side walls 20, 21. The abovedescribed folding tabs of the top wall 22 too are connected to one another by adhesive bonding.

In the case of the transverse folding principle of the main blank 27, the regions of lid front wall 18 and lid side walls 20, 21 adjoin box front wall 13 and box side walls 15, 16. The lid side walls 20, 21, on the one hand, and the box side walls 15, 16, on the other hand, are separated from one another in each case by an oblique punch cut 37, 38. Also extending in the region of lid front wall 18 and box front wall 13 is a transversely directed separation cut 39, which adjoins the ends of the punch cuts 37, 38. In this region, however, a temporary connection between the relevant walls of the box part 10, on the one hand, and of the lid, on the other hand, is achieved, to be precise by material webs 40, 41. These are thin and narrow residual connections of the material of the blanks. When the hinge-lid box is opened for the first time, the material webs 40, 41 are severed, this resulting in web remnants 42, 43 on the initially interconnected pack parts, namely box front wall 13, on the one hand, and lid front wall 18, on the other hand.

The collar 12 adjoins the main blank 27 in the region of the abovedescribed folding tabs of the top wall 22. The initial position of the collar 12 according to FIG. 3 is selected such that, after a folding operation, namely after folding the collar 12 over through 180° against the inner side of the main blank 27 (FIG. 4), the collar 12 assumes the precise position appropriate to the pack. In order to ensure this, a collar border 44, which is directed upwards in the hinge-lid box, has to be positioned, in the region of the collar side tabs 25, 26 and a lateral part of the collar front wall 24, at a distance from a transverse folding line 45 of the main blank 27 and thus from the collar front wall and collar side walls 20, 21.

While maintaining the unity of the blank, this distance is formed by intermediate pieces, in the present exemplary embodiment by triangular or trapezoidal folding gussets 46, 47 as a connection between collar 12 and main blank 27. The folding gussets 46, 47 extend in the region of upright folding edges 48, 49 of the collar 12, namely between collar front wall 24 and collar side tabs 25, 26. The folding gussets 46, 47, which taper towards the main blank 27, are connected to the latter in the region of the transverse folding line 45 and of longitudinal folding lines 50, 51 of said main blank 27. The longitudinal folding lines 50, 51 form front, upright folding edges in the hinge-lid box.

Accordingly, with the exception of the region of the folding gussets 46, 47, the collar 12 is separated, over the entire width, from the main blank 27 by a separation or punch cut which follows the contour of the collar border 44. In the case of the present example, said folding gussets 46, 47 are connected to the collar 12 merely via web-like material remnants 52, 53. Said material remnants 52, 53 are likewise severed when the hinge-lid box is opened for the first time. On the opposite side, the folding gussets 46, 47, by means of their tapering ends, are connected to the main blank 27 via an articulation web 54, 55, namely in the region of the upper ends of the longitudinal folding lines 50, 51.

Figure 2:
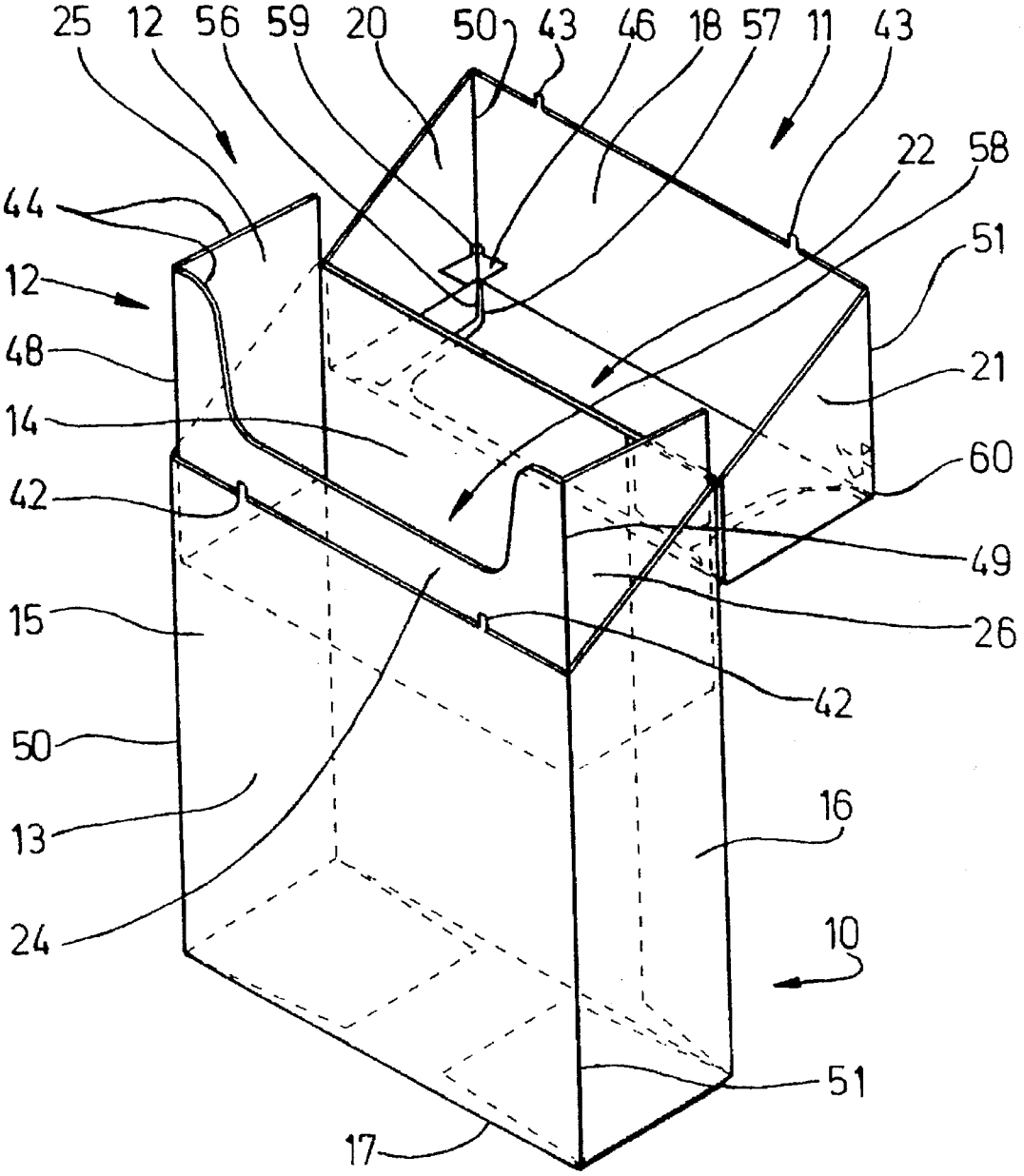
FIG. 2 shows likewise in perspective, the hinge-lid box according to FIG. 1 in the open position.

When the collar 12 is folded over out of the position according to FIG. 3 into that of FIG. 4, the folding gussets 46, 47 are accordingly folded, with the collar 12, against the inner side of the main blank 27, a folding edge being formed in the region of the articulation webs 54, 55. When the hinge-lid box is in the finished state (FIG. 2), the folding gussets 46, 47 are located in the region of front, upper corners 59, 60 of the lid 11, to be precise on the lid front wall 18 and lid side walls 20, 21. In this position, the folding gussets 46, 47 are fixed preferably by adhesive bonding, with the result that they remain in the prescribed position when the hinge-lid box is opened.

Comparatively small and narrow side tabs 35, 36 are obtained by way of the contour of the separation cut between collar 12 and main blank 27. By virtue of the configuration of the folding gusset 46, 47, said side tabs are provided with oblique edges 56. These correspond with the likewise obliquely running mating edges 57 on the inner tabs 33. Consequently, the abovementioned folding tabs can be folded into the plane of the top wall 22 without mutual contact. The three folding tabs, namely inner tab 33 and side tabs 35, 36, are located in a common plane, to be precise on the inner side of the cover tab 34.

The overall contour of the inner tab 33 corresponds to the progression of the upper collar border 44 in the region of the collar front wall 24. Therein, a depression 58 which is conventional in hinge-lid boxes is provided in the central region of the collar front wall 24 in order to facilitate removal of the cigarettes.

In the position according to FIG. 4, the collar 12 is connected, in the lower region to the walls of the box part 10, but not to walls of the lid 11. Accordingly, said lid 11 can be drawn off the collar 12 when the hinge-lid box is opened.

In order to take the geometrical specifications into account, the collar 12 is of a smaller width in the region of the all-in-one blank than in the adjoining regions of the main blank 27.

Figure 5:
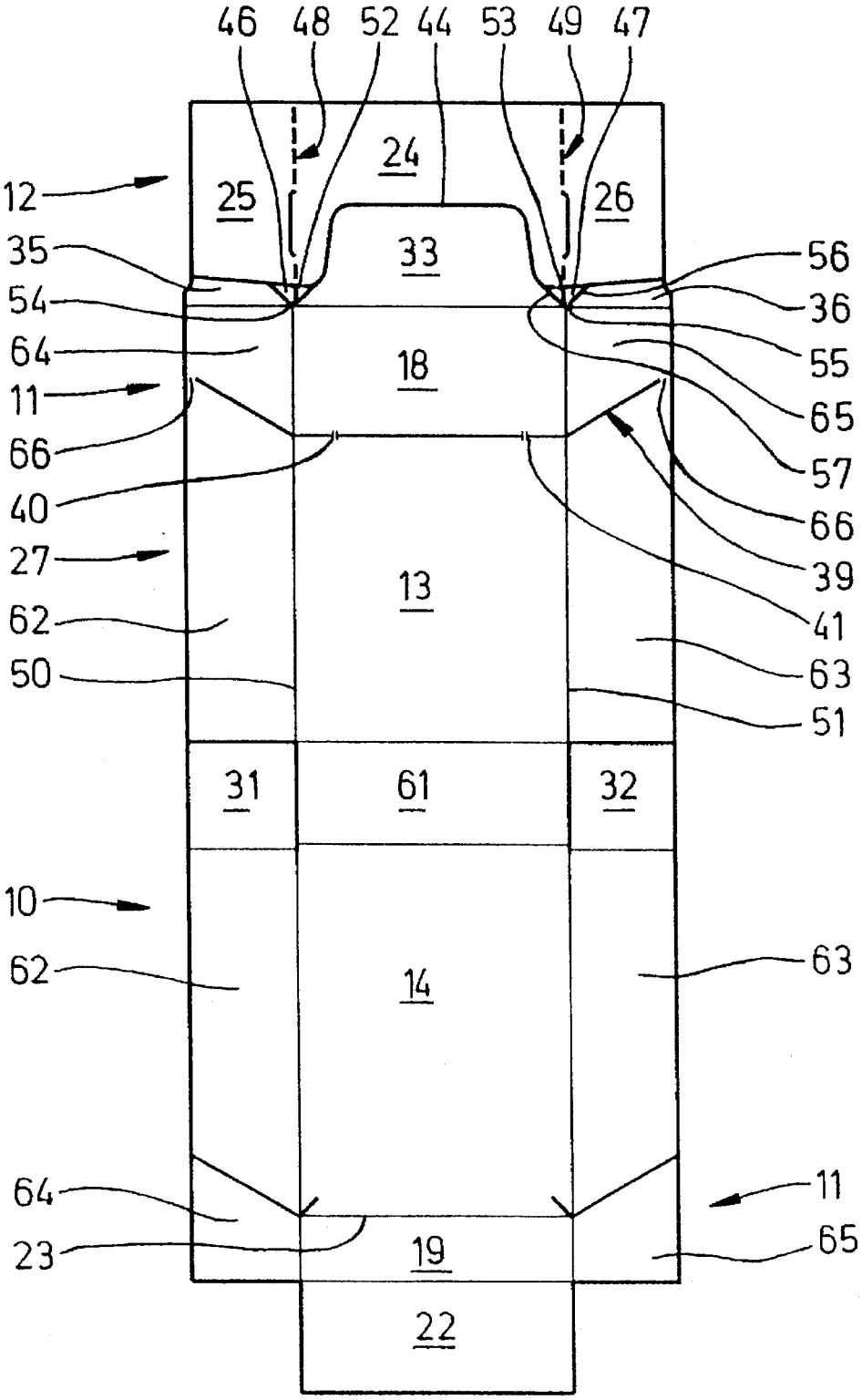
FIG. 5 shows a spread-out (all-in-one) blank of another embodiment.
Figure 6:
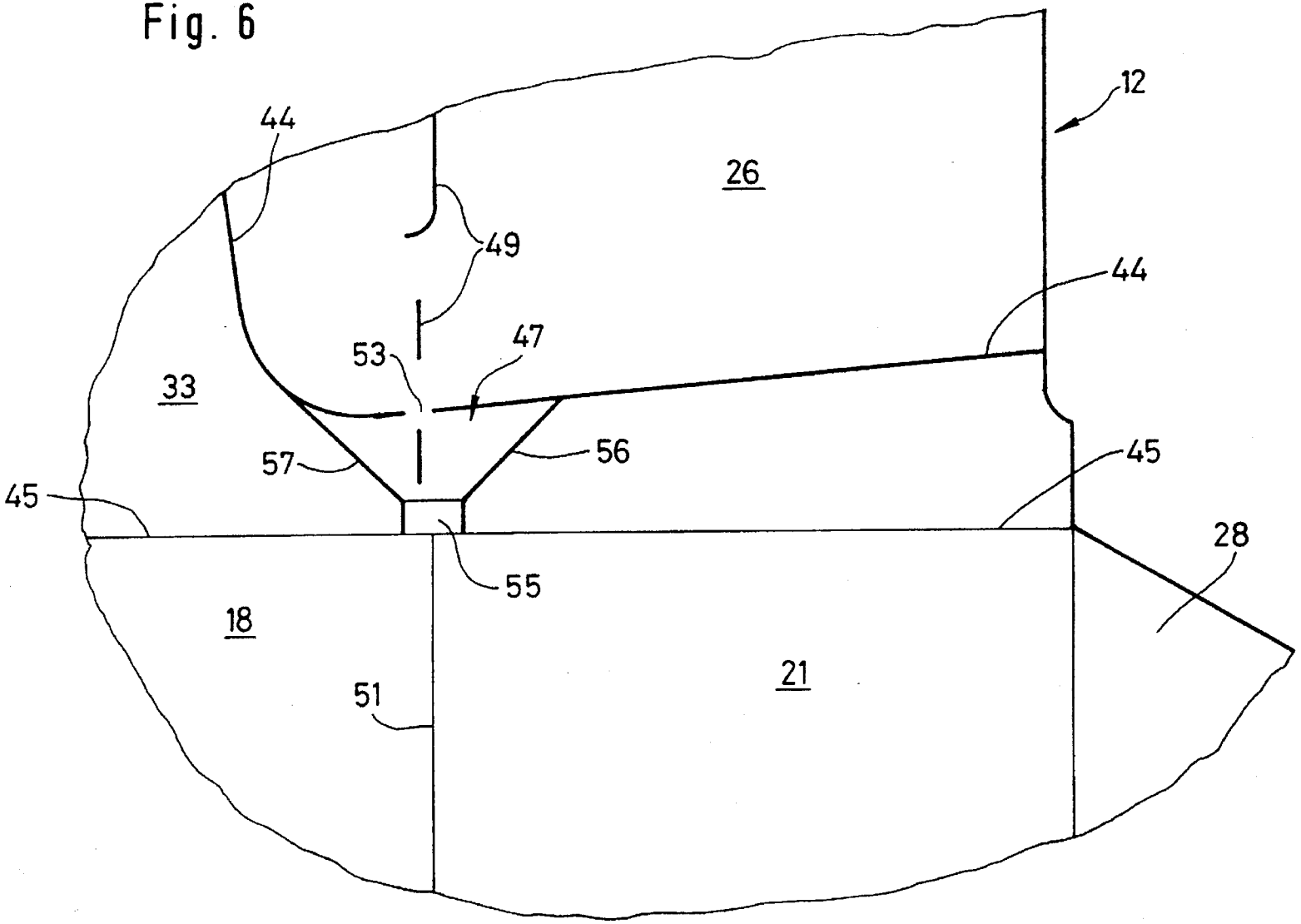
FIG. 6 shows on a vastly enlarged scale, a detail of the blank according to FIG. 3 or according to FIG. 5.

FIG. 5 shows a blank for a hinge-lid box which is configured in accordance with the longitudinal folding principle. This differs from the abovedescribed blank according to FIGS. 3 and 4 in that a continuous, single-piece base wall 61 is provided. Said base wall is positioned between box front wall 13 and box rear wall 14. By virtue of the elongate design of the blank, folding tabs and walls of the lid 11 are located at opposite end regions of the main blank 27.

There is a further difference in that the side walls of the box part 10 and of the lid 11 comprise in each case two mutually overlapping and interconnected folding tabs, namely box side tabs 62 and 63 and lid side tabs 64 and 65.

The lid front wall 18 and the outer lid side tabs 64, and 65 are separated off from the box front wall 13 and the outer box side tabs 62, 63 by a separation cut 39 which has been angled off twice, analogously to FIG. 3. The separation cut 39 terminates at a distance from the borders of the blank, thus forming a connection web 66. The blank is consequently held together in this region as well as by the material webs 40, 41.

The collar 12 adjoins the main blank 27 in a manner comparable to FIGS. 3 and 4, namely in the region of the folding gussets 46, 47. This is designed in the manner described. The same applies for the folding tabs for forming the top wall 22.

In the case of this embodiment too, the collar 12 is folded over through 180° against the inner side of box front wall 13 and lid front wall 18. The remaining folding steps are carried out in the conventional manner.

What is claimed is:

1. A hinge-lid box made of a material, and comprising a box part (10), a lid (11) connected pivotably thereto, and a collar (12) which is anchored in the box part (10) and has a sub-region that projects out of the box part, the collar (12) being connected to the lid by severable remnants (52, 53) of the material which are severed when the lid (11) is opened for the first time, wherein the collar (12) is connected to the lid (11) via intermediate folding gussets (46, 47), wherein the severable material remnants (52, 53) are formed between the collar (12) and the intermediate folding gussets (46, 47), and wherein the folding gussets (46, 47) are connected to an inner side of the lid (11) by adhesive bonding such that, when the lid (11) is opened for the first time and the material remnants (52,53) are severed, the folding gussets (46, 47) remain anchored in the lid (11).

2. The hinge-lid box according to claim 1, wherein the folding gussets (46, 47) are formed in a region of folding edges (48, 49) of the collar (12), on the one hand, and in a region of longitudinal folding lines (50, 51) of the lid, on the other hand, and wherein the folding gussets (46, 47) are positioned in a region of front, upper corners of the lid (11) and are connected to adjoining parts of the lid (11) by adhesive bonding.

3. The hinge-lid box according to claim 1, wherein, before the lid (11) is opened for the first time, a lid front wall (18) and lid side walls (20, 21) are connected to a box front wall (13) and box side walls (15, 16) via severable webs (40, 41) of the material.

4. A box blank, made of a material, for hinge-lid boxes, comprising a main blank (27) having regions, which are delimited by folding lines, for forming a box part (10) and a lid (11) connected thereto, and further comprising a collar (12) which is connected to the main blank (27) via remnants (52, 53) of the material such that, when the lid (11) of a hinge-lid box formed from said box blank is opened for the first time, the material remnants (52, 53) are severed, (a) wherein the collar (12) is connected to the main blank (27) via intermed folding gussets (46, 47) which are formed between a free collar border (44) and folding tabs for forming parts of the lid (11), (b) wherein the severable material remnants (52, 53) are provided between the collar border (44) and the folding gussets (46, 47), (c) wherein the folding gussets (46, 47) are connected to the main blank (27), in a region of the lid (11), by respective articulation webs (54, 55) of the material, and (d) wherein each of the articulation webs (54, 55) and of the material remnants (52, 53) extends in a region of longitudinal folding lines (50, 51) of the main blank and in a region of predefined folding edges (48, 49) of the collar (12).

5. The box blank according to claim 4, wherein the folding gussets (46, 47) for connecting the collar (12) and the main blank (27) are arranged in a region of the predetermined folding edges (48, 49) of the collar (12), on the one hand, and in a region of the longitudinal folding lines (50, 51) of the main blank (27) and of the lid (11), on the other hand.

6. The box blank according to claim 5, wherein the collar (12) is separated from the main blank (27) by a separation cut (39) running along the collar border (44), the separation cut separating the folding gussets (46, 47) from the collar (12) except for at least one of said material remnants (52, 53) for each folding gusset.

* * * * *